United States Patent [19]

Chatten

[11] Patent Number: 4,827,642

[45] Date of Patent: May 9, 1989

[54] DRIVE MECHANISM

[76] Inventor: Victor H. Chatten, 1567 W. 215th St., Torrance, Calif. 90501

[21] Appl. No.: 764,937

[22] Filed: Aug. 12, 1985

[51] Int. Cl.[4] ..... G09F 19/00

[52] U.S. Cl. ..... 40/426; 272/31 R; 446/136

[58] Field of Search ..... 40/470, 473, 423, 406, 40/474, 617, 606, 538, 456, 410, 409, 426, 540; 366/273, 274; 446/136, 134; 273/1 M; 219/521; 272/31 R

[56] References Cited

U.S. PATENT DOCUMENTS

| | | | |
|---|---|---|---|
| 586,366 | 7/1897 | Peterson et al. | 272/31 |
| 1,852,869 | 5/1932 | Willens | 40/473 |
| 2,082,612 | 1/1937 | Bourquin | 40/474 |
| 2,084,915 | 6/1937 | Leitch | 40/473 |
| 2,146,138 | 2/1939 | Grass | 40/474 |
| 2,323,837 | 7/1943 | Neal | 446/136 |
| 2,556,854 | 6/1951 | Spears et al. | 366/273 |
| 2,619,349 | 11/1952 | Abrahamson | 40/540 |
| 2,656,630 | 10/1953 | McDonald, Jr. | 40/473 |
| 2,743,910 | 5/1956 | Melville | 366/273 |
| 2,770,073 | 11/1956 | Sullivan | 40/426 |
| 2,843,950 | 7/1958 | Reitz | 40/474 |
| 2,859,020 | 11/1958 | Eddy et al. | 366/274 |
| 3,006,111 | 10/1961 | Koch | 446/136 |
| 3,113,228 | 12/1963 | Tolegian | 366/273 |
| 3,239,956 | 3/1966 | Canonica, Jr. | 40/426 |
| 3,325,930 | 6/1967 | Braeutigam | 40/473 |
| 3,340,633 | 9/1967 | Silberman | 40/473 |
| 3,387,393 | 6/1968 | Musser | 446/136 |
| 3,535,805 | 10/1970 | Peiperl | 40/406 |
| 3,551,709 | 12/1970 | Kemenczky | 40/470 |
| 3,590,505 | 7/1971 | Benchley, Jr. | 40/473 |
| 3,614,959 | 10/1971 | Schollmaier et al. | 366/274 |
| 3,654,716 | 4/1972 | Moss | 40/473 |
| 3,660,917 | 5/1972 | Bevan | 40/473 |
| 3,665,625 | 5/1972 | Moss | 40/473 |
| 3,791,058 | 2/1974 | Mollica | 40/473 |
| 3,859,743 | 1/1975 | Schoenung | 40/473 |
| 4,070,819 | 1/1978 | Kelly | 40/473 |
| 4,304,060 | 12/1981 | Tanguay | 446/136 |
| 4,534,656 | 8/1985 | de Bruyne | 366/273 |
| 4,540,289 | 9/1985 | Cheng et al. | 366/274 |

FOREIGN PATENT DOCUMENTS

| | | | |
|---|---|---|---|
| 1129930 | 1/1957 | France | 446/136 |
| 632757 | 2/1962 | Italy | 40/473 |
| 816624 | 7/1959 | United Kingdom | 446/136 |

*Primary Examiner*—Robert Peshock
*Assistant Examiner*—J. Hakomaki
*Attorney, Agent, or Firm*—Lyon & Lyon

[57] ABSTRACT

The device wherein the second, minute or hour stem of the conventional quartz clock movement is used to provide a motive force for continuous rotation, for use in ornamental or advertising displays and the like. The quartz movement mechanism is housed in a base structure or frame. A system of counterpart magnets, one counterpart being attached to the stem of the clock movement within the base structure or frame, the other counterpart magnet attached to the rotatable display structure which is caused to pivot such that the magnets are situated sufficiently close to one another so that rotation of the stem is communicated to the display structure.

9 Claims, 3 Drawing Sheets

DRIVE MECHANISM

BACKGROUND

This invention pertains to a drive mechanism wherein a conventional electronic quartz clock movement, and a system of magnets, are used to provide continuous rotation of a display structure for up to one year. It is believed that this device would find primary utility in providing a motive force for rotation of ornamental, advertising or novelty displays.

The ability to provide continual rotation for up to one year in such things as point-of-purchase advertising displays, ornamental and novelty items such as lamp bases, curios, and desk top photograph displays, is indeed desirable. The advertising industry has long recognized the fact that movement catches the eye, and the advertisement that works best is the one that is seen and read. In the past, however, providing rotational movement for such articles has involved the use of electric motors powered by alternating current, which requires an electrical cord and outlet; or powered by large D-cell batteries which, if run continually, need to be replaced in weeks' time. The cost, complexity and inconvenience of these type mechanisms have proven to be a substantial drawback to the provision of rotational movement in such articles.

Therefore, a need exists for a simple drive mechanism that can provide such continuous rotational movement.

SUMMARY OF INVENTION

The device of this invention provides such a drive mechanism. Utilizing a conventional quartz clock movement which will operate for more than a year on one small-cell battery as the power source, a display structure is caused to rotate continuously by using a system of magnets for power transmission. A first magnet, preferably a button or U-shaped magnet, is attached to the second hand stem of the clock movement, such that the magnet is rotated at one rpm. (Attaching the magnet to the minute hand stem or the hour hand stem, provides for slower rotation proportionately). A second magnet is attached to the display structure, and means are provided for pivotally supporting the display structure such that the second magnet can align with, and be in the magnetic field of, the first magnet. Therefore, the movement of the first magnet is communicated to the second magnet, causing the display structure to rotate.

In any movement, friction is the primary obstacle. Reducing friction allows for greater movement with less force. Here, in one embodiment, the display structure pivots upon a needle point. In addition to providing the power transmission, the interaction of the magnets also works to maintain the display structure in balance and centered on the needle point, so that friction is reduced to the extent possible.

Utilizing this device, and even using the smallest quartz clock unit powered with a single double A battery, a one pound display structure can be rotated continuously at up to one rpm for more than a year.

Also, the magnet transmission system allows the quartz movement to be hermetically sealed in a watertight frame, such that it can be used to provide rotational movement in an underwater setting.

It is, therefore, the object of this invention to provide a novel and useful rotational drive mechanism.

DETAILED DESCRIPTION OF THE PREFERRED EMBODIMENT

Figure 1:
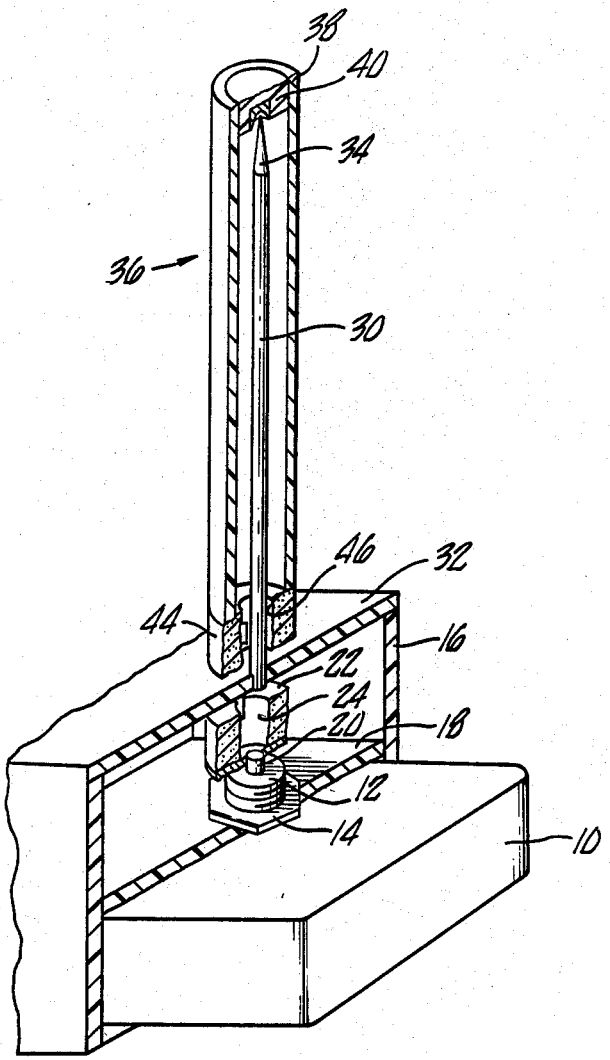
FIG. 1 is a perspective view, with a portion cut away, of the preferred embodiment of this invention, showing the quartz clock movement and the magnetic transmission system.

The source of rotational movement in this device is a conventional quartz clock movement 10. Such movements are commercially available. A unit manufactured by Tochigi Tokai Co., Ltd., of Japan has proven workable. These units are sold in any number of watch and time service retail outlets in the United States. The clock movement 10 has a hollow, threaded lug 12 and nut 14 to provide the means by which the clock movement 10 can be attached to a clock face. Here, the clock movement 10 is attached to frame 16 by means of inserting lug 12 through an appropriately sized aperture in cross-member 18, and securing it there by means of nut 14. If the drive mechanism is to be utilized in an underwater setting, frame 16 can be easily made watertight by hermetically sealing all joints.

Through the hollow portion of lug 12 typically extend the stems to which the hour, minute and second hands of a clock face are to be attached. Depending upon the rotational speed desired, two of the three stems are removed, leaving only one. In the preferred embodiment, rotational speed of one rpm is desired, so the hour and minute stems are removed, leaving only the second hand stem 20 protruding from the clock movement 10 through lug 12.

Attached co-axially to the second hand stem 20 is a first button-type magnet 22. (Other shape magnets such as U-shaped or a type known as "holding" magnets are also suitable). Such magnets are commercially available in a variety of diameters and heights. These magnets are also commercially available with center bore holes 24 of varying diameter and slots 26 of varying sizes. The first button-type magnet 22 is glued to a circular metal plate 28 which is in turn welded to the stem 20.

Figure 3:
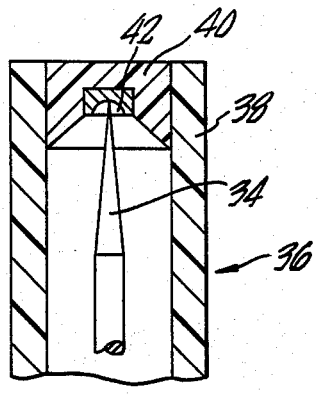
FIG. 3 is an enlarged view in isolation of the pivot point of the display structure on the needle point shaft.
Figure 2:
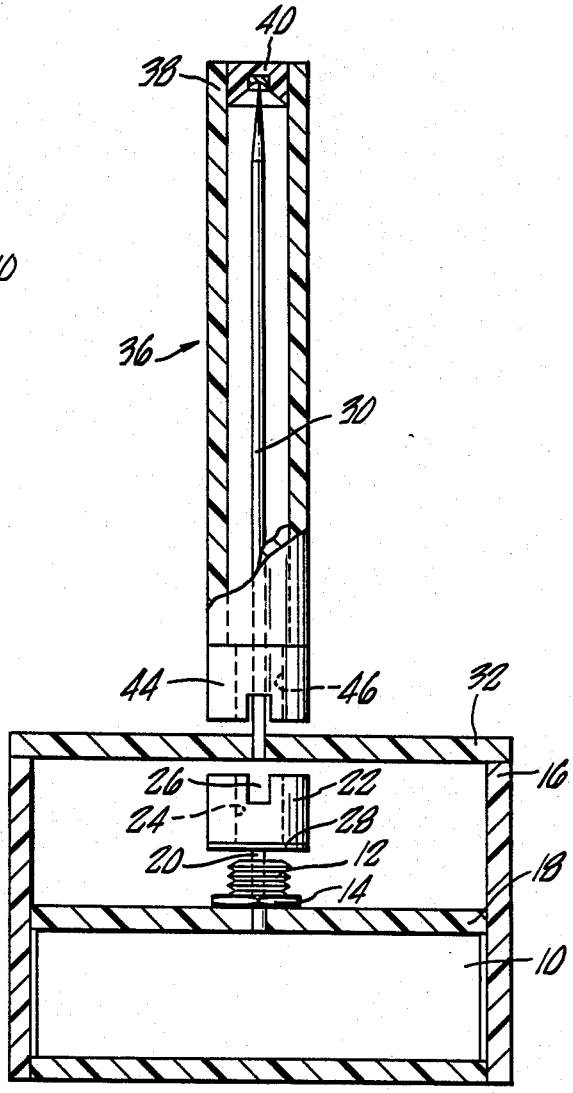
FIG. 2 is a side view showing the quartz movement, the magnetic transmission system, and the manner in which the display structure is pivoted upon a needle point shaft.

In the preferred embodiment, as shown in FIGS. 1–3, the support for the rotating display is provided by means of a shaft 30 which is fixedly attached to top plate 32 of frame 16, such that it is co-axially aligned with stem 20 of the clock movement 10. The distal end 32 of shaft 30 has a severe needle point configuration. The needle point 32 of shaft 30 is preferably of hard case steel so that needle point 32 will remain as sharp as possible during use. The remainder of shaft 30 is preferably of a non-magnetically attractive material, such as brass. Of course, shaft 30 and frame 16, including top plate 32, must be sufficiently strong to hold the weight of whatever display is to be rotated upon shaft 30.

The display is attached by conventional means to display structure 36. In the preferred embodiment, display structure 36 has a hollow, cylindrical body, the outside diameter of which is equal to the outside diameter of first button-type magnet 22. An end plug 40 is inserted into a first end of body 38. Inset into the interior side of end plug 40 is a conventional watch jewel 42. It is this watch jewel 42 which becomes the pivot point on end 32 of shaft 30.

At the other end of display structure 36, a second button-type magnet 44 of the same size and shape as first button-type magnet 22 is fixably attached. Note that the center bore 46 of magnet 44 is substantially larger in diameter than the diameter of shaft 30 such that there is substantial clearance between shaft 30 and magnet 44 when the display structure 36 is journalled on shaft 30. The length of display structure 36 is such that when it is in position on shaft 30, second magnet 44 does not contact top plate 32 of frame 16, but is sufficiently close thereto such that it acts upon, and is acted upon by, first magnet 22. Similarly, the arrangement and position of clock movement 10 and its attachments in frame 16 is such that first magnet 22 does not contact top plate 32, but is sufficiently close thereto such that it acts upon, and is acted upon by, the magnetic field generated by second magnet 44.

In operation then, when the clock movement 10 is equipped 'with the appropriately sized battery and turned on, second hand stem 20 will rotate at one rpm. This will cause first magnet 22 also to rotate at one rpm. Due to the magnetic attraction between first magnet 22 and second magnet 44, the rotation of first magnet 22 will be communicated to second magnet 44, such that second magnet 44 also will rotate at one rpm, as

171/165

PATENT will the display structure 36, and any display which is attached thereto. In addition to providing the transmission of the power across plate 32, the magnets 22 and 44, by virtue of their magnet attraction, are self-aligning such that the display structure 36 will remain centered on shaft 30. This self-alignment of magnets 22 and 44 will also insure that magnet 44 will not wobble into contact with shaft 30. Accordingly, this interaction of the magnets 22 and 44 reduces friction substantially. Using the smallest available clock movement 10, which is powered by a single double-A battery, a display weighing up to one pound can be continuously rotated by this drive mechanism for up to one year.

Figure 4:
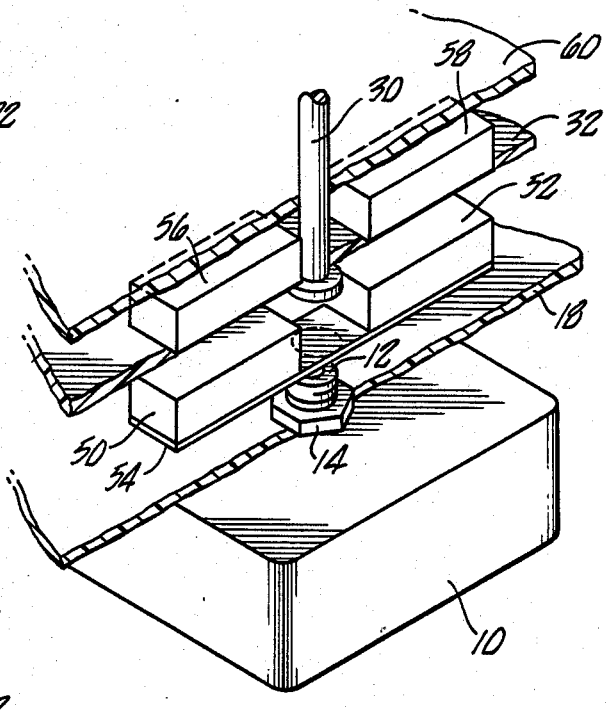
FIG. 4 is a perspective view of an alternative embodiment, showing the use of a pair of bar magnets to replace the button or U-shaped magnet.

In FIG. 4, an alternative embodiment is shown. Here, the same clock movement 10 is attached to top plate 32 by lug 10 and nut 14. Instead of the button-type magnets, however, a pair of bar magnets 50 and 52 are glued to a flat bar 54 which is in turn welded to the second hand stem 20. Similarly, a second pair of bar magnets 56 and 58 are attached to a bottom plate 60 which is in turn attached to the base of display structure 36. It should be understood that any number of aligned magnets could be utilized. In this embodiment, bar magnets provide the same transmission and alignment functions as the button-type magnets previously described.

Figure 5:
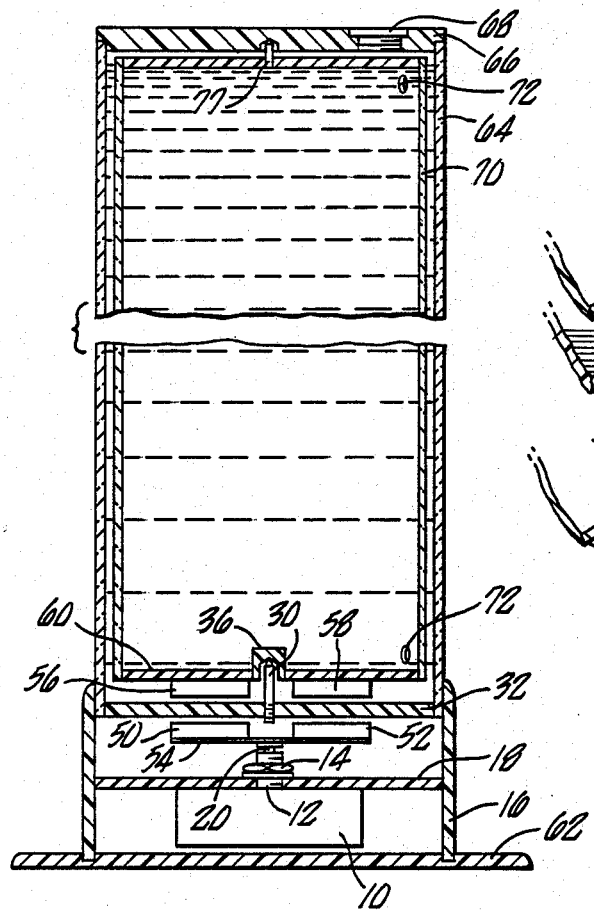
FIG. 5 is a side view in cross section showing a type of display, this one in an aqueous setting, with which the drive mechanism of this invention is particularly useful.

In FIG. 5, the device is shown being used to rotate a large display in an aqueous setting. Here, the frame 16 includes an enlarged foot plate 62 and a water-tight drum 64 having head piece 66 and fill plug 68. The display 70 is attached to base plate 60 which is in turn attached to the display structure 36. Apertures 72 in the sides of the display 70 allow the water to enter. An additional centering device can be utilized in which a center pin 74 protruding perpendicularly above the display 70 engages a tap 76 bored into head plate 66. As the bar magnets 50 and 52 are rotated by the clock movement 10, the display 70 is also caused to rotate. A display 70 could be weighted to have a specific gravity approximating that of the fluid within frame 16 such that a very heavy display 70 could be rotated utilizing the drive mechanism of this invention.

Figure 6:
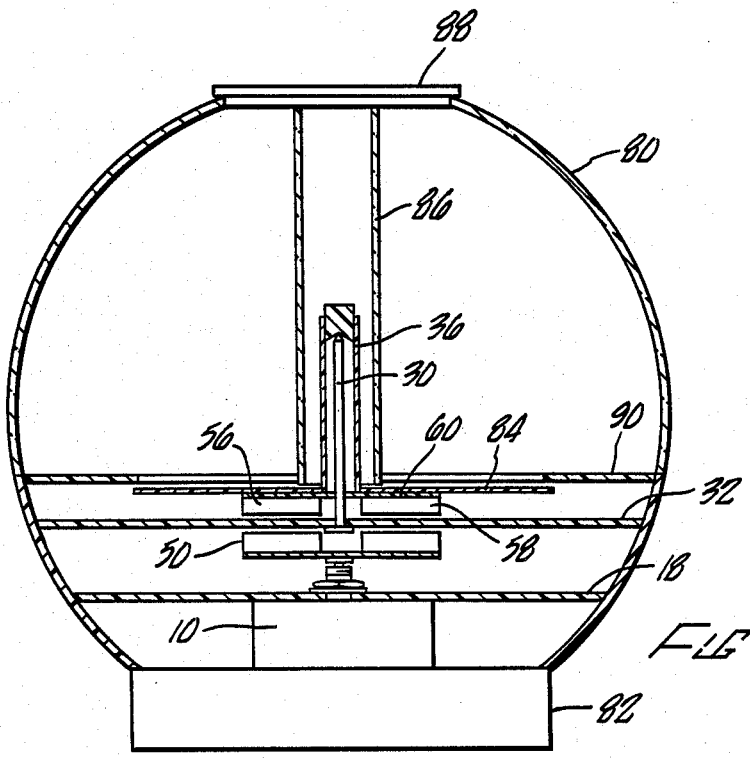
FIG. 6 shows another type display which can be utilized with this invention.

In FIG. 6, another type display with which the drive mechanism of this device could be utilized is shown. Here, a glass ball 80 rests upon support 82. The clock movement 10 is attached to cross-member 18 which rests against the insides of the glass ball 80. The shaft 30 is attached to the top plate 32 which also rests against the insides of the glass ball 80. Here, the base plate 60 is in tur attached to a support plate 84 upon which the ttems desired to be rotated within the glass ball 80 are placed. The display support 36 is hidden within a center column 86 which is attached to the bottom of the lid 88. A flange plate 90 rings the interior of glass ball 80 above the support 84 for aesthetic purposes.

Figure 7:
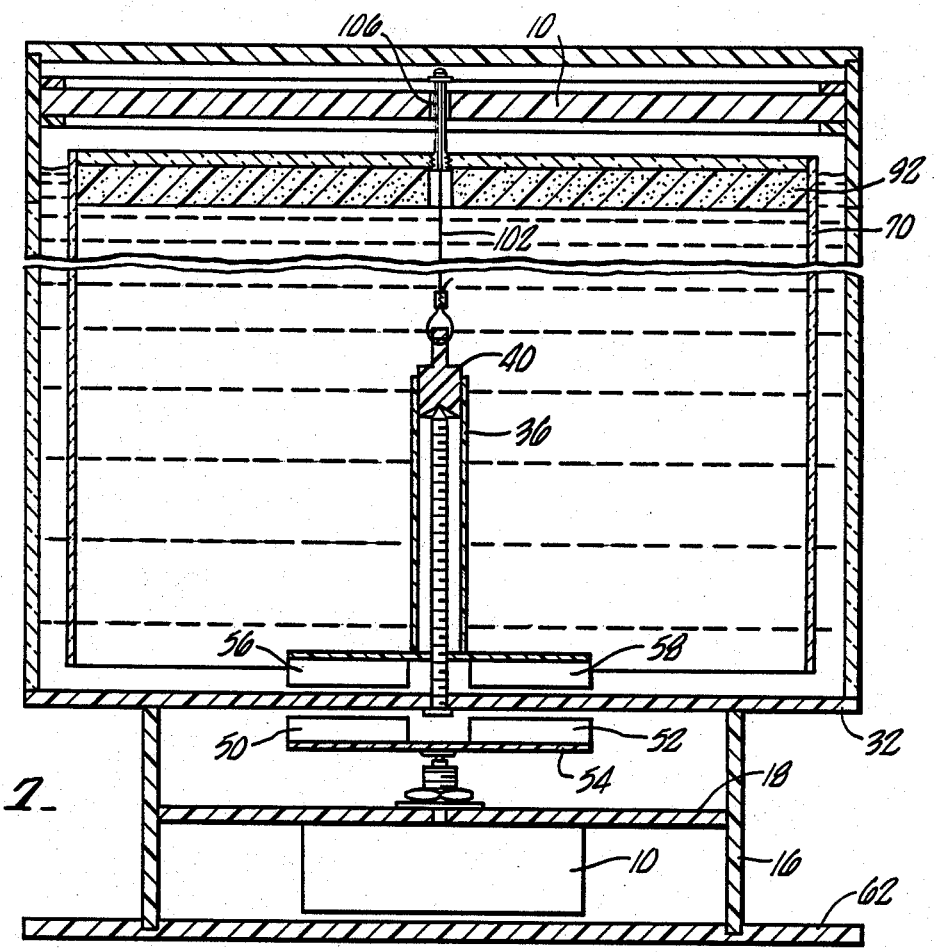
FIGS. 7 and 8 show the device of this invention being utilized to rotate a heavy display in which the buoyancy of the display is utilized.

In FIG. 7, another means for atachment of the display 70 to the display support 36 is shown. Here, the display 70 is made buoyant within frame 16 by attachment of buoyant material 92 to the underside of the top plate 78 of the display 70. A hollow pin 100 is attached centrally to the top plate 78 and extends thereabove. At the distal end of pin 100, suspension wire 102 is attached. Suspension wire 102 is attached at its other end to end plug 40 by looping suspension wire 102 through an aperture in end plug 40. To provide centering, pin 100 extends through and above a centering plate 104, which has an aperture 106, having a greater diameter than the exterior diameter of pin 100. Movement of the display support 36 is communicated by means of suspension wire 102 to the display 70.

Figure 8:
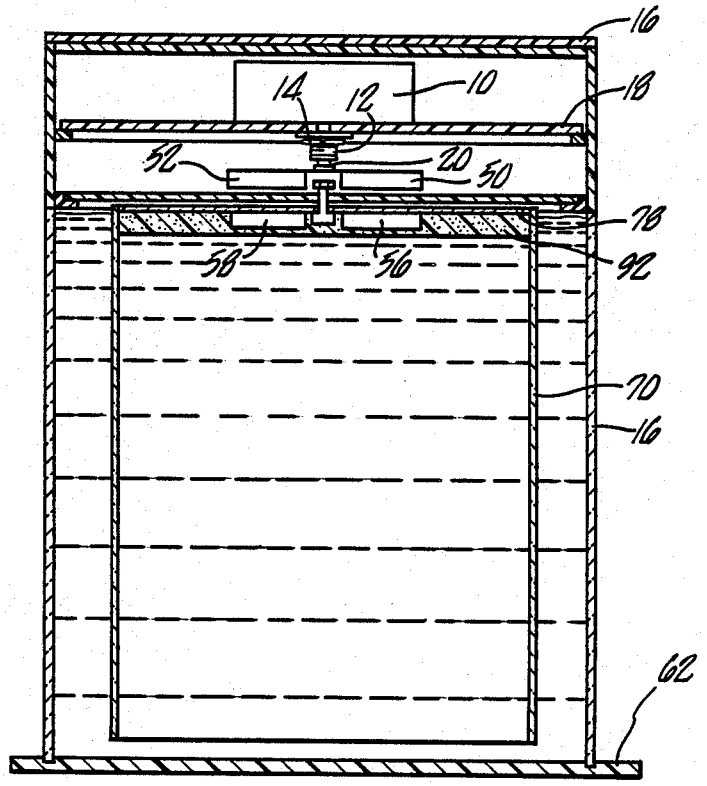

The drive mechanism of this invention can also be used in an inverted position as shown in FIG. 8. Here, the crossmember 18, to which the clock movement 10 is attached, is located at the top of the overall display assemblage, and in the inverted position, such that magnets 50 and 52 are posed beneath the clock movement 10. The magnets 56 and 58 are attached to the underside of top plate 78 of th display 70, which is made buoyant by the addition of buoyant material 92. The level of the fluid within frame 16 is regulated so that magnets 56 and 58 are brought into sufficiently close proximity with magnets 50 and 52 so they can act upon another.

Although the invention hereinafter claimed has been shown and described above with particularity, it will be apparent to those skilled in the art that other modifications upon the embodiments shown and described may be made without departing from the inventive concepts claimed herein. Accordingly, the scope and protection of this patent are not to be limited to the embodiments specifically shown and described above, but are of the full breath and scope of the appended claims.

What is claimed is:

1. A drive mechanism for causing continuous rotation for up to one year of a display structure, the mechanism (a) a conventional battery driven quartz clock movement having a rotatable stem, said movement housed within a frame;
(b) at least a first magnet attached to said stem such that rotation of said stem causes said first magnet to rotate;
(c) at least a second magnet attached to the display structure; and
(d) means for supporting the display structure such that said first and second magnets are magnetically attracted such that rotation of said first magnet is communicated to said second magnet, causing the display structure to rotate.

2. The device of claim 1 werein said support means comprises a bearing shaft attached to said frame and extending co-axially with and perpendicularly above said stem, upon which the display structure is journaled.

3. The device of claim 1 wherein said support means comprises fluid in said frame, and means for making the display structure buoyant in said fluid.

4. A drive mechanism comprising:
(a) a conventional battery driven quartz clock movement having a rotatable stem, to which a first button-type magnet is fixedly and centrally attached, this assembly attached to a frame;
(b) a shaft attached to and extending perpendicularly above said frame and the center of said first button-type magnet, co-axially with said stem;
(c) a display structure suspended on said shaft, said display structure having a central pivot point which engages and pivots upon the distal end of said shaft; and
(d) a second-button type magnet fixedly attached to the bottom of said display structure and encircling said shaft, said second button-type magnet being above said frame but sufficiently close to said first button-type magnetic, such that rotation of said first button type magnet by means of said quartz clock movement is communicated magnetically to said second button-type magnet which, in turn, causes said display structure to pivot on said shaft.

5. The invention of claim 4 wherein said frame is hermetically sealed such that the device is fully submergible.

6. The device of claim 4 wherein said shaft has a needle point on the distal end thereof.

7. The device of claim 6 wherein said pivot point of said display structure comprises a conventional watch jewel to reduce friction.

8. The invention of claim 4 wherein said shaft is constructed of a non-magnetically attracted material.

9. A drive mechanism comprising:
(a) a conventional battery driven quartz clock movement having a rotatable stem, to which a pair of bar-type magnets are attached in radial alignment such that rotation of said stem causes rotation of said magnets; this assemblage housed within a frame;
(b) a shaft attached to said frame and extending perpendicularly above and co-axially with said stem;
(c) a display structure pivotable upon the distal end of said shaft;
(d) a second pair of bar-type magnets attached to said display structure; said magnets being above said base structure but sufficiently close to said first pair of bar-type magnets such that rotation of said stem is communicated via said magnets to cause rotation of said display structure.

* * * * *